US009562367B2

(12) United States Patent
Chaput et al.

(10) Patent No.: US 9,562,367 B2
(45) Date of Patent: Feb. 7, 2017

(54) UTILITY TOWER LIFTING APPARATUS AND METHOD

(71) Applicant: AMPJACK INDUSTRIES LTD., Winnipeg (CA)

(72) Inventors: Luke Joseph Chaput, Selkirk (CA); Douglas Corey Krokosz, Thompson (CA)

(73) Assignee: AMPJACK INDUSTRIES LTD., Winnipeg (CA)

( * ) Notice: Subject to any disclaimer, the term of this patent is extended or adjusted under 35 U.S.C. 154(b) by 0 days.

(21) Appl. No.: 13/870,128

(22) Filed: Apr. 25, 2013

(65) Prior Publication Data

US 2013/0283726 A1 Oct. 31, 2013

Related U.S. Application Data

(60) Provisional application No. 61/638,165, filed on Apr. 25, 2012, provisional application No. 61/749,541, filed on Jan. 7, 2013.

(51) Int. Cl.

| | |
|---|---|
| ***E04H 12/00*** | (2006.01) |
| ***E04H 12/34*** | (2006.01) |
| ***B66F 3/46*** | (2006.01) |
| ***E04H 12/10*** | (2006.01) |

(52) U.S. Cl.
CPC ..... *E04H 12/344* (2013.01); *B66F 3/46* (2013.01); *E04H 12/10* (2013.01)

(58) Field of Classification Search
CPC ..... E04H 12/00; E04H 12/34; E04H 12/344
USPC ..... 52/123.1, 126.1, 745.17
See application file for complete search history.

(56) References Cited

U.S. PATENT DOCUMENTS

| | | | | |
|---|---|---|---|---|
| 2,656,149 | A * | 10/1953 | Campbell | 254/92 |
| 3,828,513 | A * | 8/1974 | Vanderklaauw | 52/745.04 |
| 4,205,826 | A | 6/1980 | Broeke et al. | |
| 4,678,372 | A * | 7/1987 | Cousty | 405/196 |
| 5,322,265 | A * | 6/1994 | Keuck | 254/89 H |
| 2013/0008097 | A1 | 1/2013 | Margevicius et al. | |

OTHER PUBLICATIONS

International Search Report & Written Opinion of PCT/CA2013/000393 dated Jul. 30, 2013.

* cited by examiner

*Primary Examiner* — Patrick Maestri
(74) *Attorney, Agent, or Firm* — Barnes & Thornburg LLP; Mark J. Nahnsen

(57) ABSTRACT

A utility tower lifting apparatus and method for raising a lattice tower in addition to carried transmission cables without disturbing the tower foundation, disconnecting the cables, or requiring de-energization of the transmission lines.

8 Claims, 9 Drawing Sheets

UTILITY TOWER LIFTING APPARATUS AND METHOD

PRIORITY

This application claims priority under 35 U.S.C. §119(e) to U.S. Provisional Application Ser. No. 61/638,165, filed Apr. 25, 2012 and Application Ser. No. 61/749,541, filed Jan. 7, 2013, which are both expressly incorporated by reference herein.

FIELD OF THE DISCLOSURE

The present disclosure relates generally to lifting equipment, and more specifically to lifting equipment used in the electric utility industry.

BACKGROUND

The electric utility industry is seeking to correct existing ground or aerial transmission line clearance problems or increase the capacity of existing electric power transmission lines while maintaining the required ground clearance through upgrades to the current transmission infrastructure. Utilities have increased the loads carried by power lines to meet ever-increasing demand during peak loading conditions, such as, for example, those that occur with seasonal heating and air-conditioning loads. This increased line loading creates additional transmission line sag resulting in wire to ground and or object clearance violations. Also, utilities are faced with increasing wire/hardware ground and aerial clearance requirements brought on by erection of nearby structures and/or new codes and/or regulations, which impose new clearance requirements on existing tower line infrastructure.

To mitigate changing (increasing) line height requirements, some utilities in the industry have addressed the need to increase tower heights by adding a tower extension (insert) to the body of the tower generally located at the waist or mid-portion of the tower. The tower extension increases the tower height and eliminates the need to replace or change out the existing lattice structure or string new cables. The current method involves splitting the tower at its connection location and using a crane to lift the top section of the tower to the desired height so the extension can be placed within the open section of the tower. The extension is then attached to both the top and bottom section of the existing tower. When tower extensions are performed in this manner the power lines, communication lines, and other equipment carried must be de-energized and disconnected and reconnected to the structure once the extension is put in place. This results in considerable downtime of the entire power transmission and communication system. Moreover, this procedure can only be conducted on structures which have near perfectly balanced weight loads so the top suspended section of the tower can be hoisted without rotation. If the weight loads are unbalanced the tower height cannot be increased in this manner.

SUMMARY

The present disclosure may comprise one or more of the following features and combinations thereof.

In illustrative embodiments, the present disclosure is directed to an electrical transmission tower lifting device for elevating an upper portion of the electrical transmission tower with respect to a lower portion of the tower from a first elevation to a second elevation. The tower lifting device includes a lower lifting structure, having a plurality of mounts to allow the lower lifting structure to be releasably secured to the lower portion of the tower a distance from the foundation of the tower and a series of lower support members that are interconnected to form the lower lifting structure.

In illustrative embodiments, the tower lifting device also includes an upper lifting structure, that is positioned above and connected to the lower lifting structure, the upper lifting structure includes a plurality of mounts to allow the upper lifting structure to be releasably secured to the upper portion of the tower. The upper lifting structure including a series of upper support members that are interconnected to form the upper lifting structure. Hydraulic lifting cylinders are adapted to be coupled to one of the lower or upper lifting structures to lift the upper lifting structure away from the lower lifting structure to raise the upper portion of the tower to the second elevation. The lifting tower device also includes a controller that is configured to control the movement of the hydraulic lifting cylinder to raise the upper portion of the tower.

These and other features of the present disclosure will become more apparent from the following description of the illustrative embodiments.

BRIEF DESCRIPTION OF THE DRAWINGS

FIG. 3 is a side elevational view of a utility lattice tower at its original first height before being lifted by the tower lifting apparatus to an elevated second height;

FIG. 4 is a side elevational view of the utility lattice tower of FIG. 3 showing the tower lifting apparatus positioned within the utility lattice tower prior to lifting the upper portion of the utility lattice tower;

FIG. 5 is a side elevational view of the utility lattice tower showing the upper portion separated and being raised from the lower portion of the utility lattice tower to the elevated second height by extending the hydraulic cylinders of the lower lifting cube;

FIG. 6 is a side elevation view of the utility lattice tower showing new tower inserts in position to couple the upper portion of the utility lattice tower to the lower portion;

FIG. 7 is a side elevational view of the utility lattice tower showing the tower lifting apparatus removed from the extended utility lattice tower;

DETAILED DESCRIPTION OF THE DRAWINGS

Figure 2:
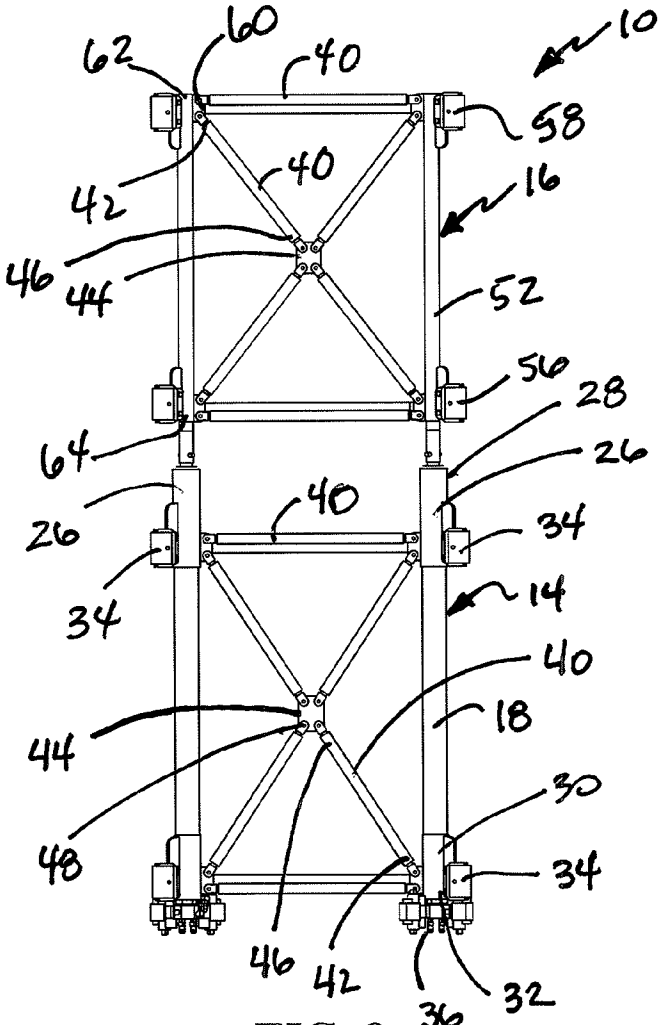
FIG. 2 is a side elevational view of the tower lifting apparatus of FIG. 1 showing the lower and upper lifting cubes interconnected by the shafts of the hydraulic cylinders and showing the interconnection of the brace members used to form the lower and upper lifting cubes, the lower and upper lifting cubes including a series of brackets that permit attachment to the utility lattice tower.

For the purposes of promoting an understanding of the principles of the disclosure, reference will now be made to a number of illustrative embodiments illustrated in the drawings and specific language will be used to describe the same.

Figure 1:
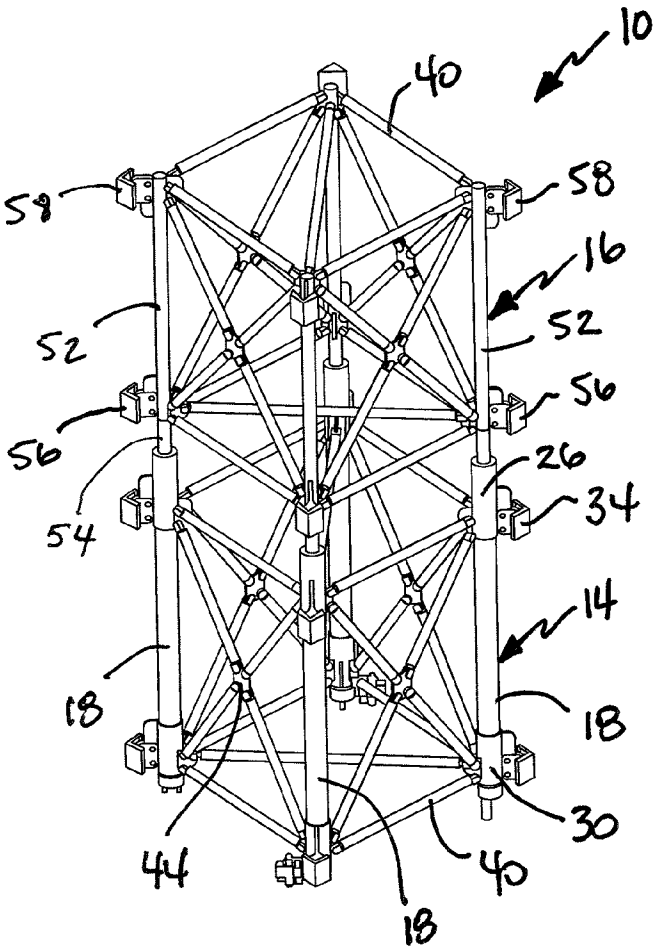
FIG. 1 is a perspective view of an embodiment of a tower lifting apparatus showing a lower lifting structure and an upper lifting structure, the lower lifting structure configured to include four independently controllable hydraulic lifting cylinders interconnected by a series of brace members to form a lower lifting cube, the upper lifting structure including four vertical supports coupled to the shafts of the hydraulic lifting cylinders, the vertical supports being interconnected by a series of brace members to form an upper lifting cube, the lower and upper lifting cubes configured to be secured to vertical members of a utility lattice tower to permit lifting of an upper portion of the lattice tower, as shown in FIGS. 3-7.

A tower lift device 10 is shown in FIG. 1. Tower lift device 10 is configured for use in connection with electrical transmission towers 12 used in the electrical power industry to raise a portion of the transmission towers 12 from a first height to a second height to elevate associated power lines, as shown, for example, in FIGS. 3-7.

Tower lifting device 10 includes a lower lifting structure 14 and an upper lifting structure 16 that can be raised and lowered with respect to the lower lifting structure 14, as shown in FIGS. 1 and 2. Lower lifting structure 14 includes four independently controllable hydraulic lifting cylinders 18 that are used to elevate the upper lifting structure 16 and an upper portion 20 of the transmission tower 12 from a lower portion 22, as shown in FIGS. 3-7.

Figure 12:
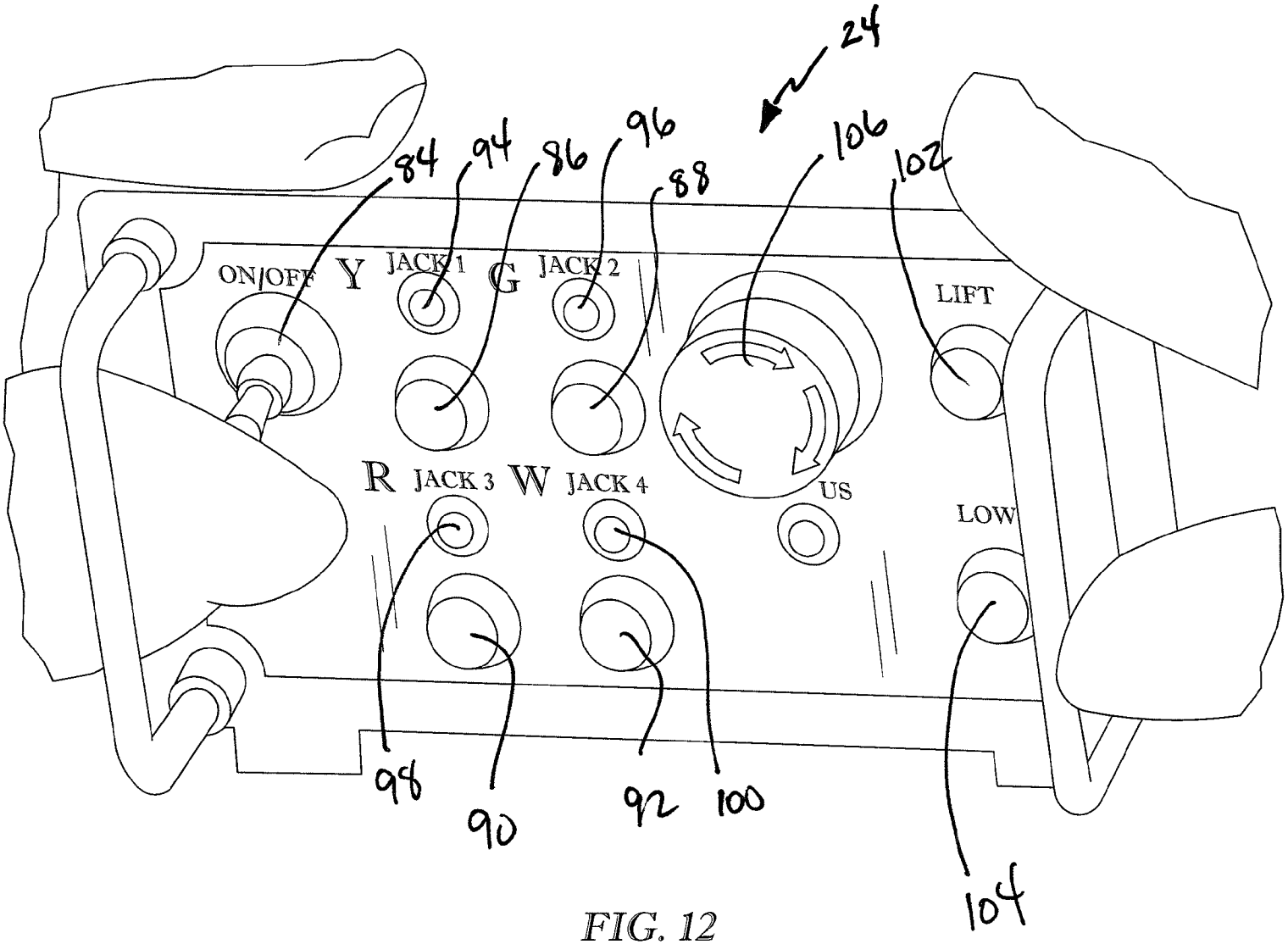
FIG. 12 is a perspective view of a remote controller that is used to control the hydraulic cylinders of the lower lifting cube permitting individual and/or simultaneous lifting of the hydraulic cylinders to permit balanced lifting of the upper portion of the utility lattice tower.
Figure 13:
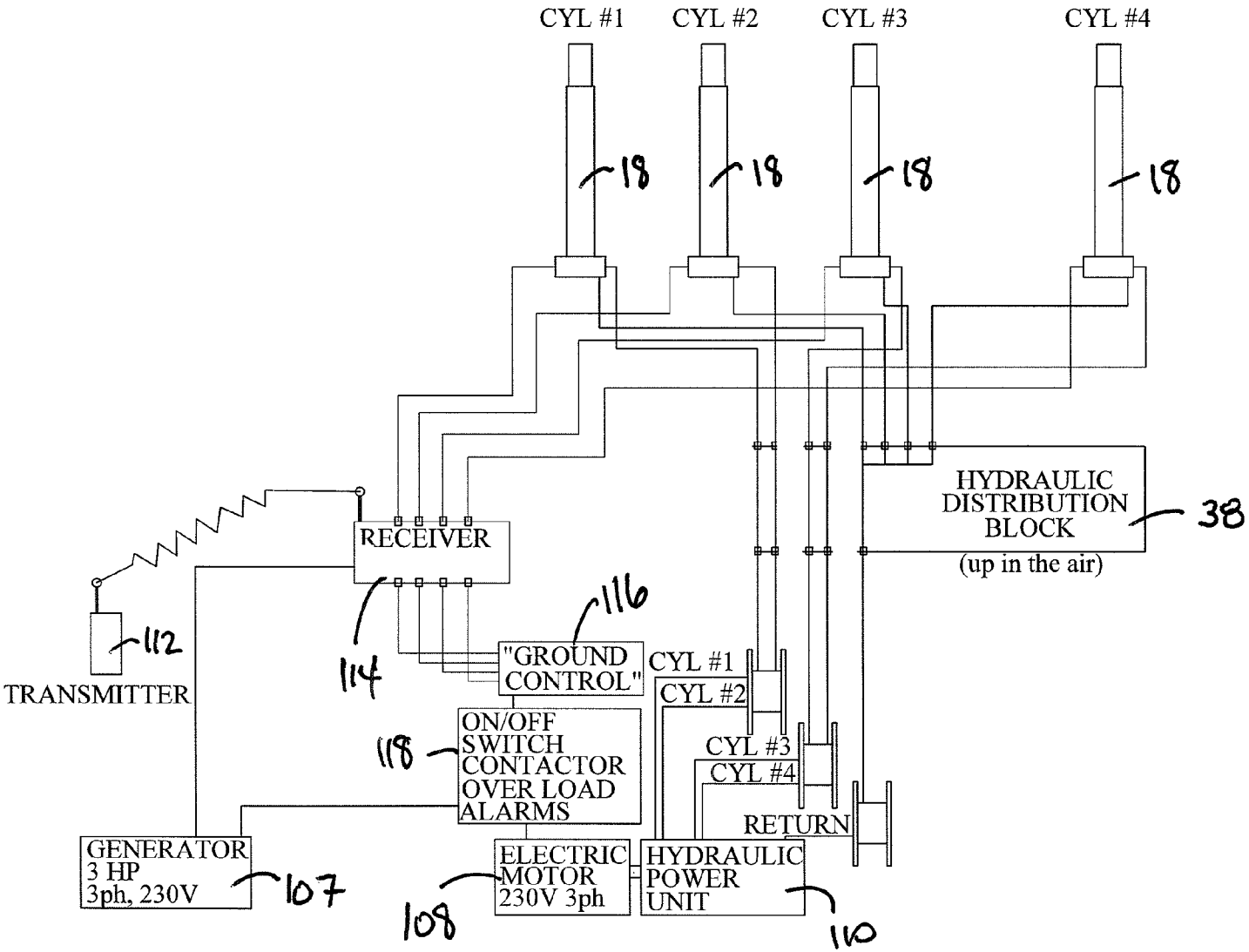
FIG. 13 is a block diagram showing the electrical and hydraulic components and lines used to control the hydraulic cylinders of the lower lifting cube of the tower lifting apparatus.

Lower lifting structure 14 includes the four lifting cylinders 18 that are controlled by a hydraulic controller 24, as shown, for example in FIG. 12. Lifting cylinders 18 include upper brackets 26 located at a first end 28 of the lifting cylinders 18 and lower brackets 30 positioned at a second end 32, as shown in FIG. 2. Each bracket 26, 20 includes a tower mount 34, used to secure the lower lifting structure 14 to a lower portion 22 of the transmission tower 12. Second end 32 of lifting cylinders 18 include hydraulic connections 36, to allow lifting cylinders 18 to be coupled to a hydraulic distribution block 38, as shown in FIG. 13.

Lower lifting structure 14 also includes a series of brace members 40 that are coupled at a first end 42 to the brackets 26, 30 and to a central hub 44 at a second end 46 to form the lower lifting structure 14. The brace members 40 include removable pins 48 at their ends to permit removal and assembly. Brace members 40 are adjustable so that they can be lengthened or shortened as needed to properly square lower lifting structure 14. Some brace members 40 extend diagonally between lift cylinders 18 and some extend horizontally to for a rigid lower lifting structure 14. Upper ends 28 of lift cylinders 18 include a boot 50. Boot 50 is an independent piece, which threads onto second end 56 of vertical supports 52 to allow for fine adjustment between the connection of the upper and lower lifting structures.

The upper lifting structure 16 including four vertical supports 52 that are coupled to the shafts 54 of the hydraulic lifting cylinders 18, as shown in FIG. 2. Vertical supports 52 of upper lifting structure 16 each include mounts 56 and 58, to allow the vertical supports 52 to be secured to upper portion 20 of the transmission tower 12. Vertical supports 52 also include brackets 60 formed and first and second ends 62, 64 thereof.

Upper lifting structure 16 also includes brace members 40 that are coupled at a first end 42 to the brackets 60 and to a central hub 44 at a second end 46 to form the upper lifting structure 16. The brace members 40 include removable pins 48 at their ends to permit removal and assembly. Brace members 40 are adjustable so that they can be lengthened or shortened as needed to properly square upper lifting structure 16. Some brace members 40 extend diagonally between vertical supports 52 and some extend horizontally to for a rigid upper lifting structure 16.

Overall height of transmission tower 12 is increased by use of tower lift device 10, as shown in FIGS. 3-7. Transmission tower 12 commonly referred to as a lattice tangent structure, is shown as comprising lattice members 66, joined with bolts 68, for supporting power transmission hardware, generally including power transmission conductors or cables, telecommunications cables, grounding, and other electrical hardware and equipment. Transmission tower 12 includes one or more cross arms 70 and braces 72. Ends of cross arms 70 include mounting hardware 74 for attachment of power transmission conductors or cables.

While a four legged tower is shown, it is to be understood that the tower lifting device 10 can be applied to any lattice tower configuration including multiple column framed structures and three and four legged structures. An example would be an H-frame lattice structure, which includes four legs in each of its columns. The tower lifting device 10 can also be used with any voltage source including AC or DC and for any voltage level, for low voltage distribution to high voltage transmission and from single circuit to multiple circuit tower configurations. The tower lifting device 10 can also be utilized to raise tangent and angle and dead-end towers including unequal span tensions across the cable attachment points.

Figure 3:
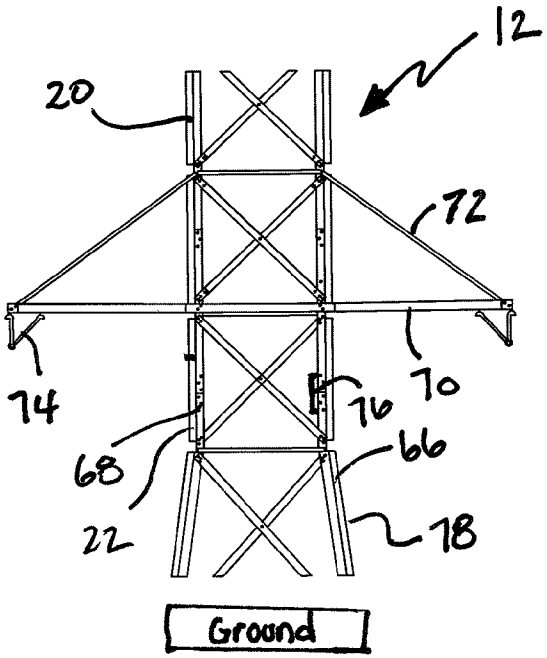
Figure 7:
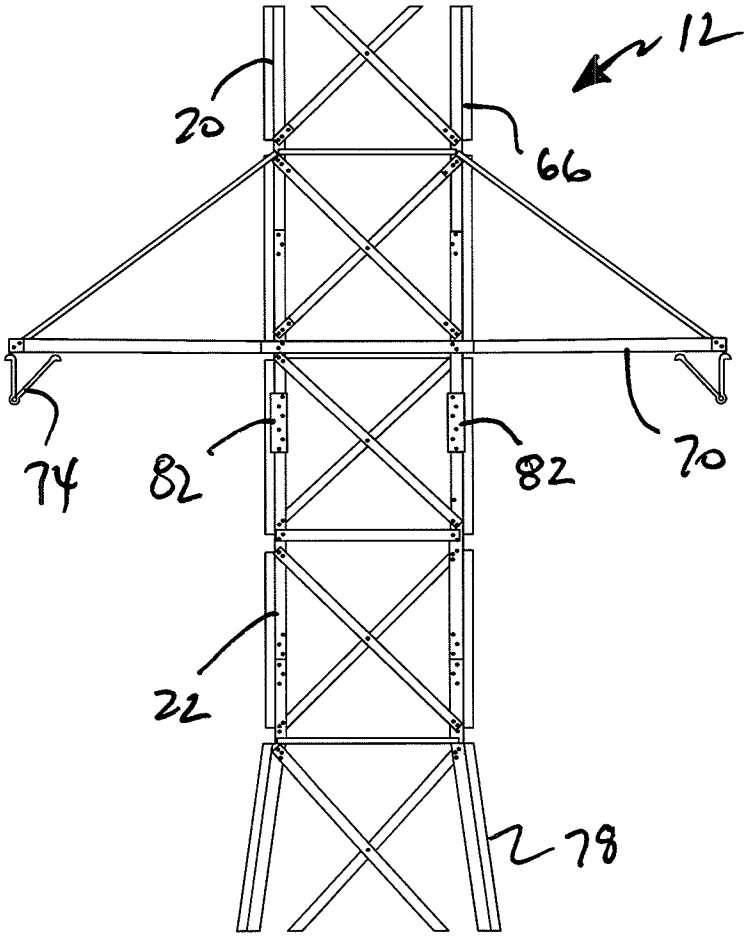

As FIG. 3 indicates, the transmission tower 12 is supported by a foundation which could be one of various designs including but not limited to; grillage, cast in place concrete, direct buried concrete or power screw anchors. The tower structure as shown in FIG. 3 can be separated into an upper tower section 20 and a lower tower section 22 interconnected by a splice plate 76 which can be disconnected allowing separation of the upper and lower tower sections 20, 22. The lower tower section 22 is formed of lattice frame members 66 and is supported on the foundation.

The upper tower section 20 is similarly formed of lattice frame members 66, as shown in FIG. 3. The upper tower section 20 is supported above the lower tower section 22 and serves to support the transmission cables thereon. In the illustrated embodiment the upper and lower tower sections 20, 22 are selected so that the upper section and lower section are defined by existing splice plates 76 in the transmission tower 12. In this instance the upper and lower tower sections 20, 22 are separated at the selected splice plates 76. In other embodiments however there may not be an existing splice plate in the transmission tower 12 at a preferred location which defines the upper tower section 20 thereabove and the lower tower section 22 therebelow. In this instance any frame members or tower legs joined between the upper and lower tower sections 20, 22 can be cut at any selected location desired to define and separate the upper tower from the lower tower section.

When the transmission tower 12 includes an inclined foundation portion 78 in which a horizontal width of the tower becomes narrower with increasing distance from the foundation, the upper and lower tower sections 20, 22 are selected such that the foundation portion 78 is fully defined within the lower tower section and such that the upper tower section is fully spaced above the foundation portion. Accordingly, the lattice frame members 66 between upper and lower tower sections 20, 22 comprises vertically oriented frame members.

Figure 4:
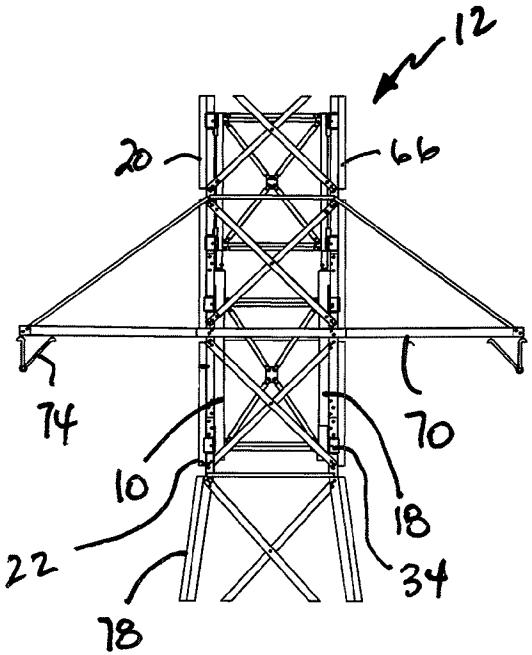
Figure 8:
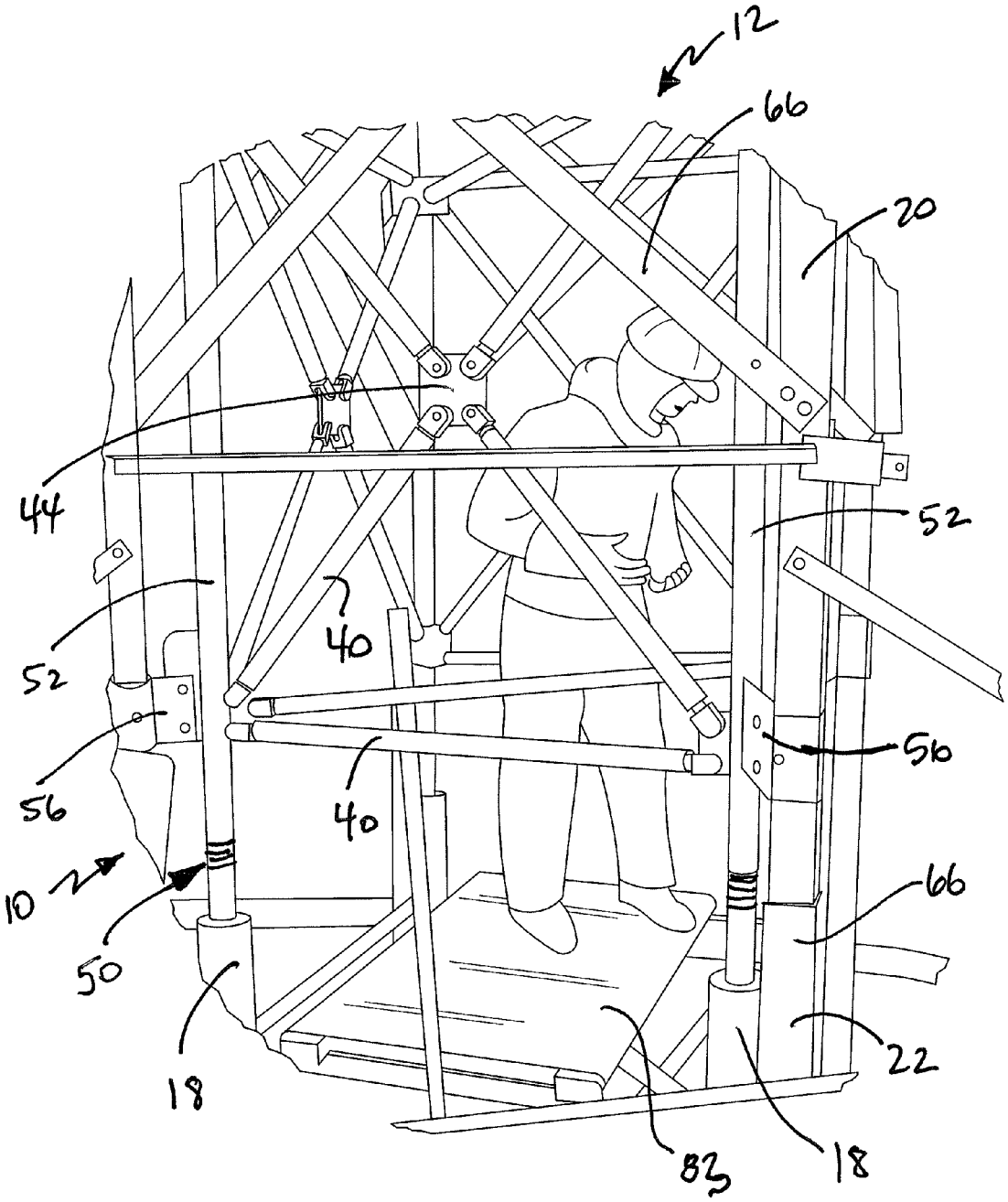
FIG. 8 is a perspective view of the tower lifting apparatus positioned within the utility lattice tower prior to lifting the upper portion of the utility lattice tower to the elevated second height.

In the next step in the process, mounting locations for the hydraulic lifting cylinders 18 and vertical supports 52 are identified as illustrated at in FIGS. 4 and 8 with holes drilled or punched for bolted/pin connections or the surface areas prepared for friction clamp connections 34, 56 and 58. These mounting locations are then used as support locations to transfer static/dynamic loads from the tower lifting device 10 reinforcement structure back to the lower tower section 22 of the lattice tower 12 and through the foundation supports. Hydraulic lifting cylinders 18 and vertical supports 52 are then attached to the tower.

Figure 5:
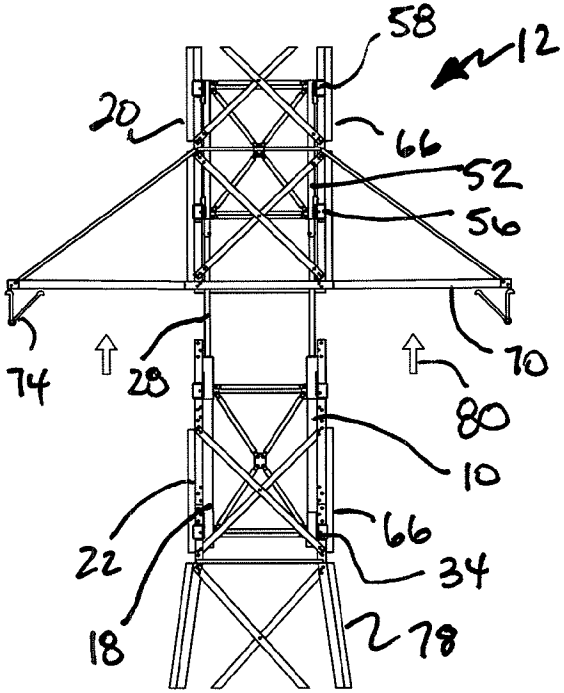
FIGS. 3-7 illustrate the steps used to elevate an upper portion of a utility lattice tower from an original first height to an elevated second height by use of the tower lifting apparatus.
Figure 9:
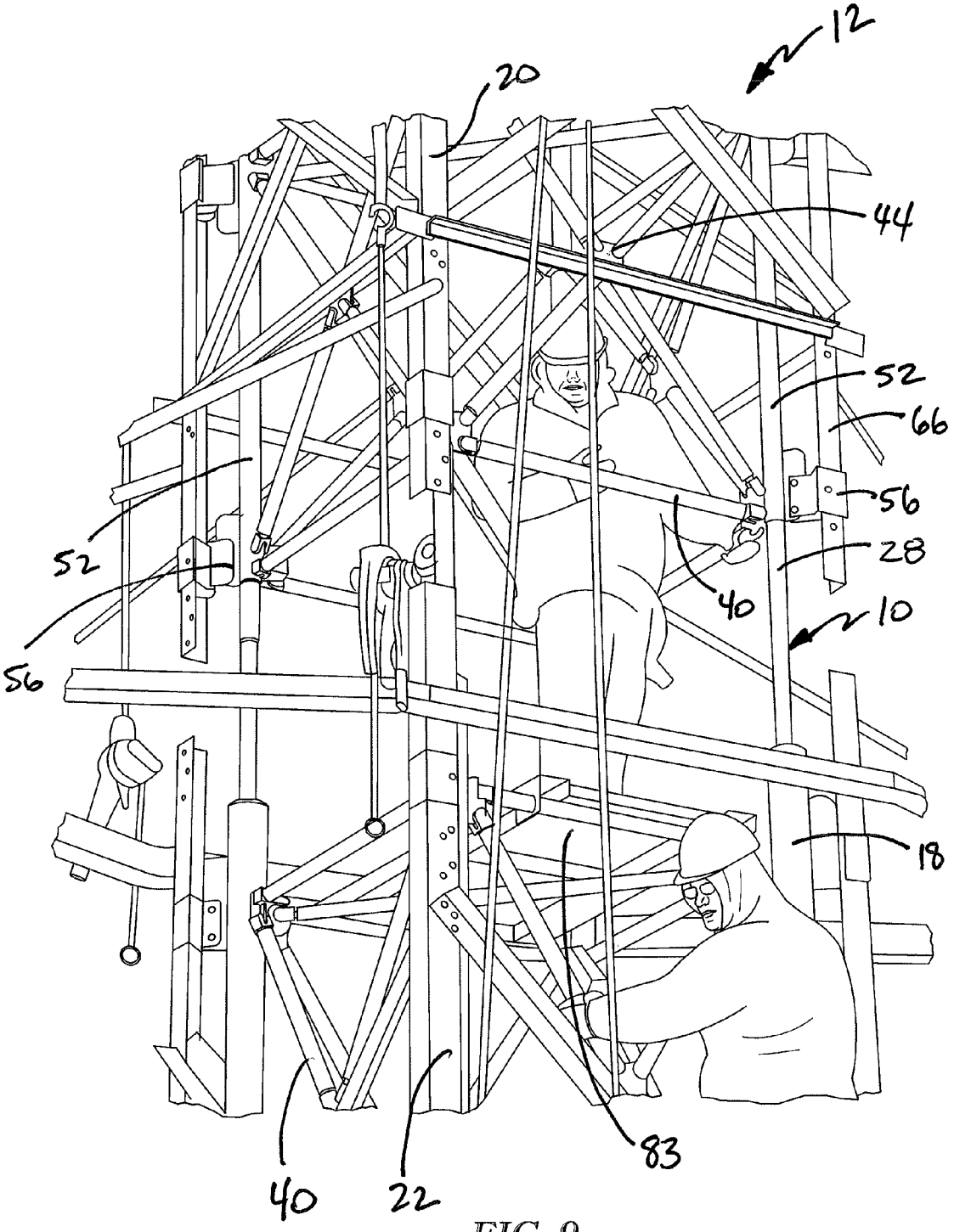
FIG. 9 is a perspective view of the tower lifting apparatus lifting the upper portion of the utility lattice tower from the original first height to the elevated second height.

In the next step in the process, tower lifting device 10 is installed in lattice tower 12 and splice plates 76 are removed from the tower 12, as shown, for example in FIGS. 5 and 9. Tower lifting device 10 is installed in the center of the lattice tower 12 with the power lines still energized. In this step, hydraulic controller 24 is used to actuate lifting cylinders 18 to elevate the upper tower section 20 in direction 80, as shown in FIG. 5. At this stage, the load from the upper tower section 20 is transferred through the tower lifting device 10 to the lower tower section 22. Tower lifting device 10 maintains the orientation of the upper tower section 20 so that it remains square with the lower tower section 22.

Figure 6:
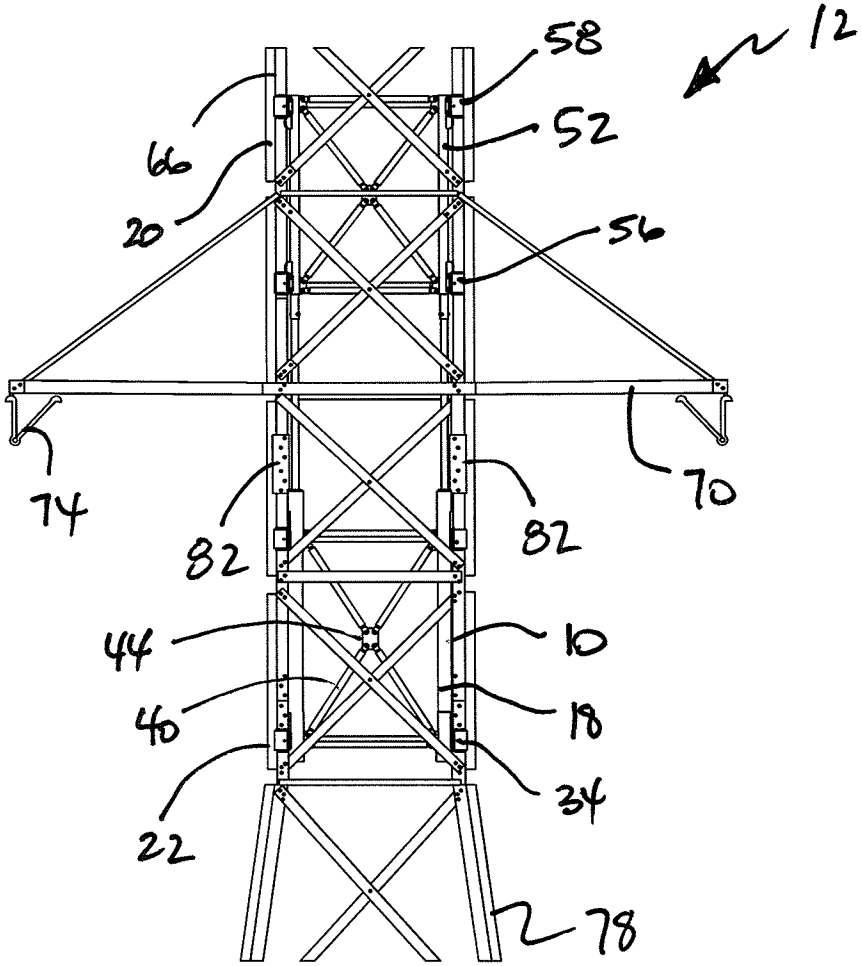
Figure 10:
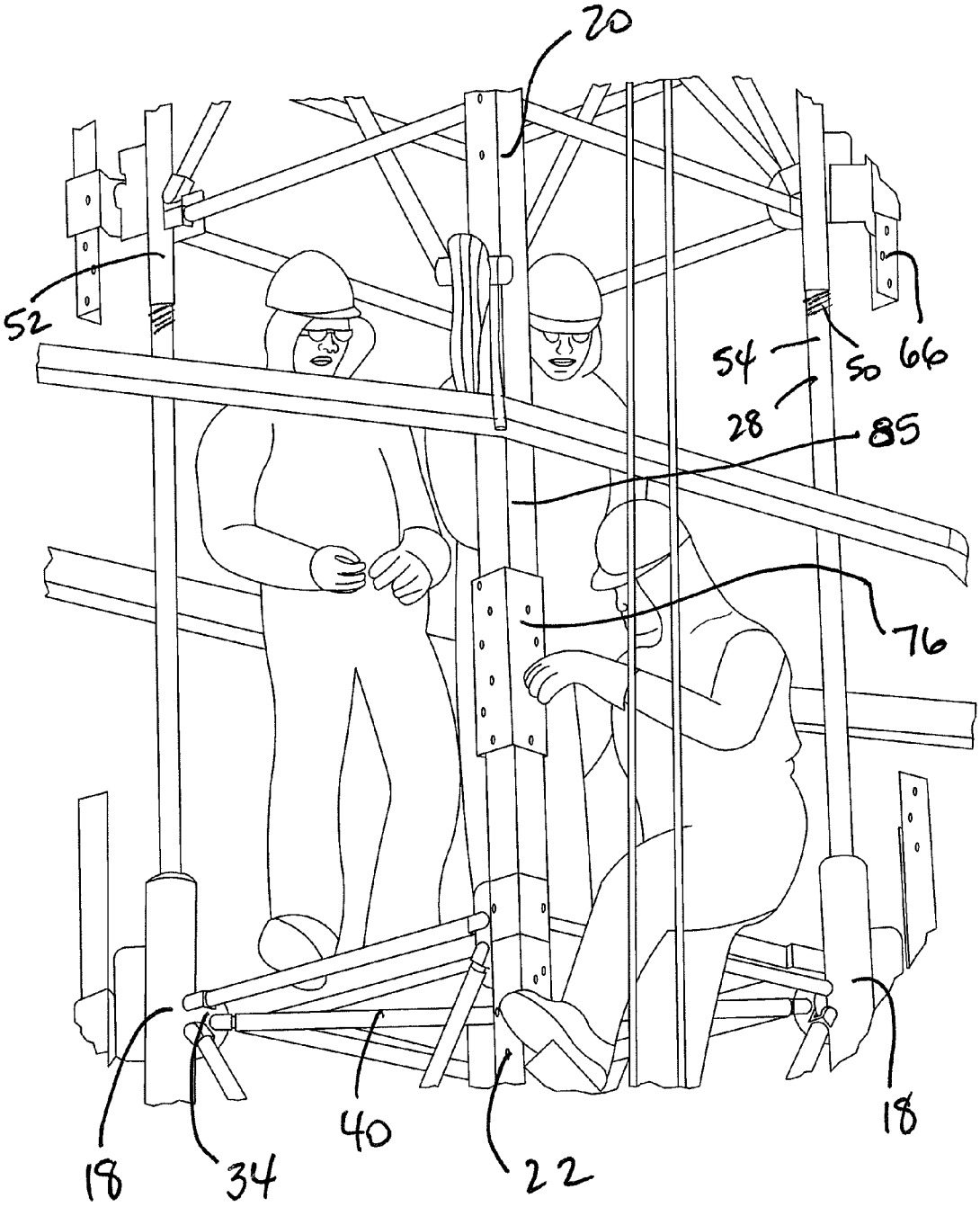
FIG. 10 is a perspective view of the utility lattice tower and tower lifting apparatus showing one of four tower inserts being installed to reconnect the upper portion to the lower portion of the utility lattice tower.
Figure 11:
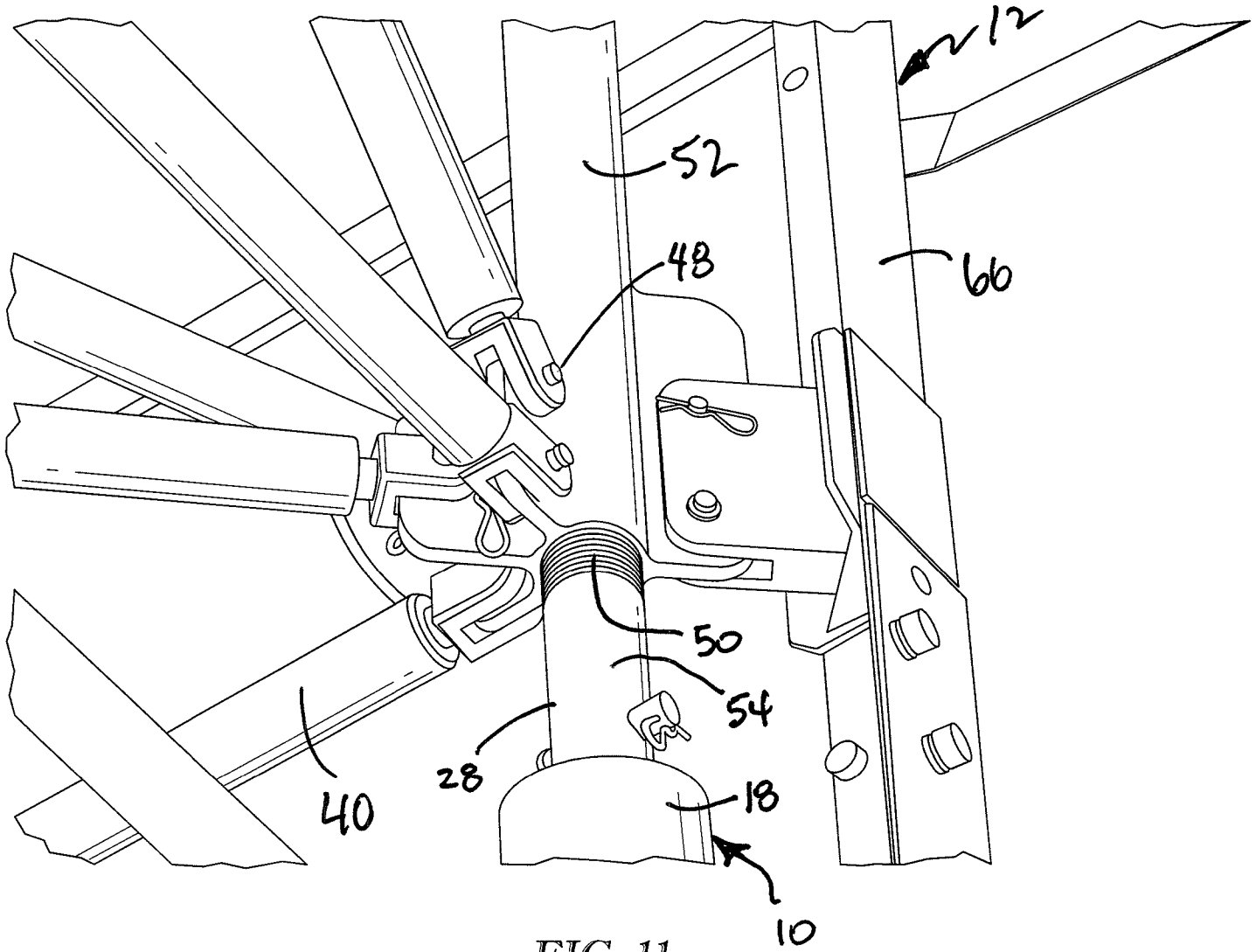
FIG. 11 is a perspective view of one of the connection joints of the upper lifting cube showing the interconnection of the brace members, and also showing the connection of the upper lifting cube to one of the vertical members of the upper portion of the utility lattice tower, the upper portion of the hydraulic ram shaft being threaded to permit incremental adjustment of the upper lifting cube with respect to the lower lifting cube to allow for proper positioning of the lifting tower apparatus with respect to the utility lattice tower.

In the next step of the process and after the upper tower section 20 of the lattice tower 12 is elevated to the desired height, tower extensions 82 are installed, reconnecting the upper and lower tower sections 20, 22, as shown in FIGS. 6 and 10. Tower extensions 82 are coupled to the upper and lower tower sections 20, 22 by use of bolts or other fasteners to secure sections together. Upper tower section 20 of lattice tower 12 is now raised and secured at the desired height. Once upper tower section 20 of lattice tower 12 is raised and secured, tower lifting device 10 can be removed from lattice tower 12. Installation and removal of the tower lifting device 10, including the raising of the upper tower portion 20 all can occur without de-energizing the power lines coupled to the lattice tower 12.

The hydraulic lifting cylinders 18 and the vertical supports 52 collectively define a lifting assembly. The vertical supports 52 of the upper lifting structure 16 include mounts 56, 58 for coupling to the lattice frame members 66 of the upper tower section 20. The hydraulic lifting cylinders 18 also include a plurality of lower mounts 34 for coupling to the lattice frame members 66 of the lower tower section 22.

The size and number of hydraulic lifting cylinders 18 are pre-determined based on the weight of the upper tower section 20 to be lifted and load carrying capacities of the hydraulic lifting cylinders 18. While the system illustrated herein includes four hydraulic lifting cylinders 18, depending on tower size and lift 10 requirements a single hydraulic lifting cylinder 18 may be sufficient or a grouping of four (or more) may be required.

Additional temporary bracing in the form of the upper and lower brace members 40 are secured to the hydraulic lifting cylinders 18 through pin/bolted connections at mounting locations in order to transmit static/dynamic loading from the hydraulic lifting cylinders 18 back to the original tower lattice structure 12. The tower lifting device components are arranged to be assembled so that they are fully contained within a perimeter boundary defined by the lattice frame members 66 of the upper and lower tower sections 20, 22. The reinforcement structure also provides structural support for temporary working platforms 83 from which personnel can carry out required activities, as shown in FIG. 8, for example. While tower lifting device 10 is shown mounted inside the lattice tower structure 12, tower lifting device 10 could also be assembled on the outside of the lattice tower in the same vertical location to raise the upper tower section 20. In this arrangement, hydraulic lifting cylinders 18 and vertical supports 52 would be located outside of lattice frame members 66.

The worker platform 83 which is arranged to support workers thereon is preferably supported on either one of the lower or upper lifting structures 14, 16 of the tower lifting device 10 so as to be also fully contained within the perimeter boundary defined by the lattice frame members 66 of the upper and lower tower sections 20, 22. The material, component thicknesses, and geometric orientation of the temporary supporting truss structure are pre-determined so as to provide the required additional structural support as required to ensure the original lattice frame members 66 are not overloaded.

Once lifting and temporary bracing components have been secured the hydraulic lifting cylinders 18 are pre-loaded so as to remove tension/compression from the lattice tower frame members 66 by applying pressure from the jacking system in the appropriate direction(s). Pre-loading of the lifting system permits the loosening of tower bolts on the splice plates 76 joining the upper tower section 20 and the lower tower section 22.

Once the splice section bolts are loosened the lifting jack pressure(s) are adjusted until the hydraulic lifting cylinders 18 and temporary vertical supports 52 are taking up the entire upper section static load and then the splice bolts are removed allowing separation of the upper tower section 20 from the lower tower section 22.

Once the upper tower section 20 is free from the lower section 22 the hydraulic lifting cylinders 18 can be used to raise the upper section 20 to a desired raised height as shown in FIG. 5. Accordingly, separation of the upper tower section 20 from the lower tower section 22 begins by initially transferring a load of the upper tower section 20 from being directly supported on the lower tower section 22 to being supported on the lower tower section 22 through the components of the tower lifting device 10.

Once the load of the upper tower section 20 and cables is carried by the tower lifting device 10, the hydraulic lifting cylinders 18 of the are uniformly actuated to raise the vertical supports 52 and the upper tower section 20 coupled thereto relative to the lower tower section 22 coupled thereto from a first elevation to a second elevation. The hydraulic lifting cylinders 18 include respective individual fluid volume controls such that each actuator individually and independently lockable for statically supporting the upper tower section 20 relative to the lower tower section 22 at either one of the first or second elevations or any desired elevation in between.

The fluid volume controls associated with the hydraulic lifting cylinders 18 permit the hydraulic lifting cylinders 18 to be uniformly extended by delivering a controlled volume of hydraulic fluid to each hydraulic lifting cylinder 18 to evenly and uniformly raise the upper tower section relative to the lower tower section even if some of the hydraulic lifting cylinders 18 are under tension and other hydraulic lifting cylinders 18 are under compression. The hydraulic lifting cylinders 18 are also provided with a pressure relief arranged to release the actuation thereof in response to a hydraulic fluid pressure which exceeds a prescribed upper limit indicative of deformation of the lattice frame members 66 of the upper or lower tower sections 20, 22.

With the upper tower section 20 raised, tower extensions 85 are installed in any safe construction fashion, including aerial framing piece by piece in a safe and efficient manner. The tower extensions 85 comprises a plurality of auxiliary frame members which are fixed between the lattice frame members 66 of the upper tower section 20 and the lattice frame members 66 of the lower tower section 22 with suitable bolted or pinned connections for permanently supporting the upper tower section 20 on the lower tower section 22 at the second elevation.

Depending on tower configuration the tower extensions 85 can be secured to either the upper or lower sections 20, 22 first and then to the opposing section next. In this step, it is preferred if the bolts are left loose to allow for easier attachment of the opposing end of the tower extensions 85. After the tower extensions 85 have been loosely secured, the tower can be checked for level and plumb and adjusted accordingly using the hydraulic lifting cylinders 18.

After ensuring the inserted tower extension 85 is level and plumb all the bolts attaching the new tower extension 85 can be torqued to the appropriate specification. Once all the tower bolts are tightened, the hydraulic lifting cylinders 18 can operated to transfer the load to the auxiliary frame members of the inserted tower extensions 85 which then supports the upper tower section 20 on the lower tower section 22 at the second elevation. The tower lifting device 10 can then be removed with any temporary modifications to the original tower and or bracing including the addition or removal of additional bracing restored to pre-lift conditions. Any field drilled holes are to be treated as per the utility specifications to prevent corrosion.

FIG. 12 illustrates a controller 24 that can be used to control the movement of the hydraulic lifting cylinders 18 in raising the upper tower section 20. Controller 24 includes a power switch 84 and hydraulic lifting cylinder control buttons 86, 88, 90, and 92. When the power switch 84 on the controller 24 is activated, it overrides the ground based control unit so the hydraulic lift cylinders 18 cannot be accidentally activated by ground personnel. Depressing any of the control buttons energizes a particular hydraulic lifting cylinder 18. Each control button has a corresponding indicator light 94, 96, 98, and 100 that indicate when a particular the hydraulic lifting cylinder 18 is activated. Direction and movement of activated cylinders is controlled by the lift and lower buttons 102, 104. Emergency shutoff 106 stops movement of cylinders 18.

FIG. 13 is a block diagram of the control system for the hydraulic lifting cylinders 18. The hydraulic lifting cylinders 18 are hydraulic coupled to hydraulic distribution block 38. Hydraulic distribution block 38 controls the flow of hydraulic fluid to and from the hydraulic lifting cylinders 18. Control system includes a generator 107 that powers an electric motor 108 to power a hydraulic power unit 110. Hydraulic power unit 110 supplies pressurized hydraulic fluid to hydraulic distribution block 38. Control system also includes a wireless transmitter 112 and a receiver 114 to receive signals from the transmitter. Transmitter 112 can be in the form of controller 24. There is also a ground controller 116 that can also be used to control cylinders 18. Control system further includes a main panel 118 that includes power switches, monitors and overload alarms. The intake lines feed directly from the hydraulic power unit to the intake valves on the hydraulic lifting cylinders 18. The return lines travel from the output valves of hydraulic lifting cylinders 18 to the hydraulic distribution block 38.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An electrical or communication transmission tower lifting device for elevating an upper frame portion of the electrical transmission tower with respect to a lower frame portion of the tower from a first elevation to a second elevation, the frame portions including a series of vertical frame members, the lifting device comprising:

a lower lifting structure positioned within the tower, having a plurality of pairs of vertically spaced apart mounts that are adapted to be coupled along a length of the vertical frame members of the lower frame portion to allow the lower lifting structure to be releasably secured to the lower frame portion of the tower a distance from the foundation of the tower, the lower lifting structure including a series of horizontal brace members that extend between the mounts and a series of diagonal support members that extend diagonally between the vertically spaced apart mounts and are interconnected at their proximate midpoint by hubs to form the lower lifting structure;

an upper lifting structure, that is positioned above the lower lifting structure and within the tower, the upper lifting structure having a plurality of pairs of vertically spaced apart mounts that are adapted to be coupled along a length of the vertical frame members of the upper frame portion to allow the upper lifting structure to be releasably secured to and adapted to support the entire upper frame portion of the tower, the upper lifting structure including a series of horizontal brace members that extend between the mounts and a series of diagonal support members that extend diagonally between the vertically spaced apart mounts and are interconnected at their proximate midpoint by hubs to form the upper lifting structure;

a lifting cylinder that is to the lower and upper lifting structures, the lifting cylinder configured to assist in moving the upper lifting structure away from the lower lifting structure to raise the upper frame portion of the tower to the second elevation; and a controller that is configured to control the movement of the lifting cylinder to raise the upper frame portion of the tower.

2. The tower lifting device of claim 1, wherein the lower lifting structure includes the lifting cylinder, the lifting cylinder having one end that is coupled to a vertical support of the upper lifting structure, such that activation of the lifting cylinder elevates the vertical support of the upper lifting structure.

3. The tower lifting device of claim 2, wherein the lower lifting structure includes additional lifting cylinders that are connected to corresponding vertical supports of the upper lifting structure, wherein activation of the lifting cylinders elevates the vertical supports of the upper lifting structure.

4. The tower lifting device of claim 3, wherein the vertical supports each include a mount to permit connection to the tower.

5. The tower lifting device of claim 3, wherein the load from the upper frame portion of the tower is transferred through the vertical supports and lifting cylinders to the lower frame portion of the tower when the upper frame portion of the tower is separated from the lower frame portion of the tower.

6. The tower lifting device of claim 3, wherein each lifting cylinder can be actuated independently of the other lifting cylinders to plumb the upper portion of the tower with respect to the lower portion.

7. The tower lifting device of claim 1, further including a generator, an electric motor driven by the generator and a hydraulic power unit driven by the electric motor, wherein the hydraulic power unit supplies pressurized hydraulic fluid to the lifting cylinder.

8. An electrical or communication transmission tower lifting device for elevating second frame portion of the electrical transmission tower with respect to a first frame portion of the tower from a first elevation to a second elevation, the first and second frame portions including a plurality of spaced apart vertical members, the lifting device comprising:

a first lifting structure, having a plurality of vertically oriented telescoping lift members each including vertically spaced apart mounts adapted to be coupled along a length of the vertical members of the first frame portion to allow the first lifting structure to be releasably secured to the first frame portion of the tower a distance from the foundation of the tower, the first lifting structure including a series of diagonal support members extending between the lift members, the diagonal support members are interconnected at proximately their midpoint by hubs to form the first lifting structure;

a second lifting structure having a plurality of vertically spaced apart mounts adapted to be coupled along a length of the vertical members of the second frame portion to allow the second lifting structure to be releasably secured to and adapted to support the entire upper frame portion of the tower, the second lifting structure including a series of diagonal support members that are interconnected at proximately their midpoint by hubs to form the second lifting structure;

the lift members attached at a lower end to the first lifting structure and at an upper end to the second lifting structure, and configured to assist in moving the second lifting structure away from the first lifting structure to raise the entire second frame portion of the tower to the second elevation; and a controller that is configured to control the movement of the lift members to raise the second portion of the tower.

* * * * *